United States Patent [19]

Cohen

[11] 4,017,090

[45] Apr. 12, 1977

[54] CLOSURE STRIP

[75] Inventor: Irvin Cohen, Reading, Pa.

[73] Assignee: Construction Fasteners, Inc., Wyomissing, Pa.

[22] Filed: July 16, 1973

[21] Appl. No.: 379,486

[52] U.S. Cl. ..... 277/206 R; 52/94; 52/403; 277/228

[51] Int. Cl.[2] ..... E04B 1/68

[58] Field of Search ..... 52/90, 94, 403; 49/475, 49/495, 482, 484; 277/227, 228, 231, 233, 206, 209; 404/66, 67

[56] References Cited

UNITED STATES PATENTS

| | | | |
|---|---|---|---|
| 1,986,465 | 1/1935 | Dempsey | 49/482 |
| 2,101,883 | 12/1937 | Warner | 404/67 |
| 2,111,113 | 3/1938 | Fischer | 404/66 |
| 2,520,089 | 8/1950 | Lippincott | 277/227 |
| 2,853,330 | 9/1958 | Harry | 277/206 |
| 3,004,783 | 10/1961 | Webb | 277/227 |
| 3,135,070 | 6/1964 | Waring | 52/94 |
| 3,385,018 | 5/1968 | Harry | 277/206 |
| 3,413,389 | 11/1968 | Footner | 49/475 |

OTHER PUBLICATIONS

Architectural Catalog File, "Sweets," 1970, p. 5, 21c/ALU.

*Primary Examiner*—John E. Murtagh
*Attorney, Agent, or Firm*—Synnestvedt & Lechner

[57] ABSTRACT

A closure or sealing strip for interposition between corrugated or otherwise sinuous sheathing panels for walls or roofs or other building surfaces and a supporting or other frame element, the sealing strip comprising a laminated body in which the opposite longitudinal edges of the laminations are adapted to contact the sheathing panels and the frame element respectively, and in which the laminations are composed of a resilient polymer and have relatively dense surface skins and relatively porous interior portions. Where the strips are to support relatively heavy loads, one or more of the laminations may be of substantially greater density than the others. The sealing strips are provided with interlocking means at their ends, such as dovetail connections, whereby a number of the strips may be readily joined together in endwise relationship.

12 Claims, 7 Drawing Figures

FIG. 1
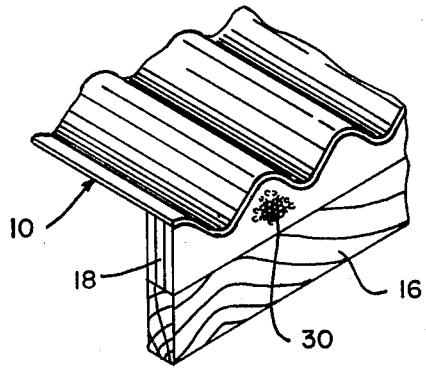
FIG. 2
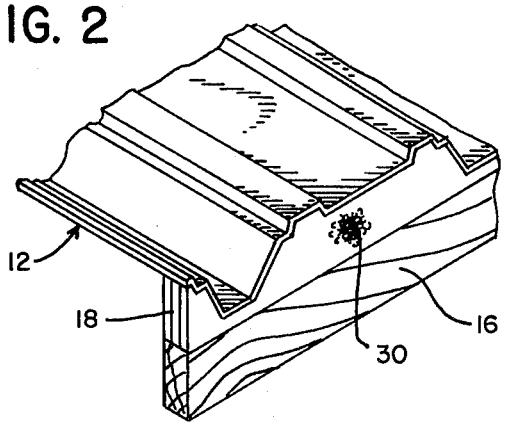
FIG. 3
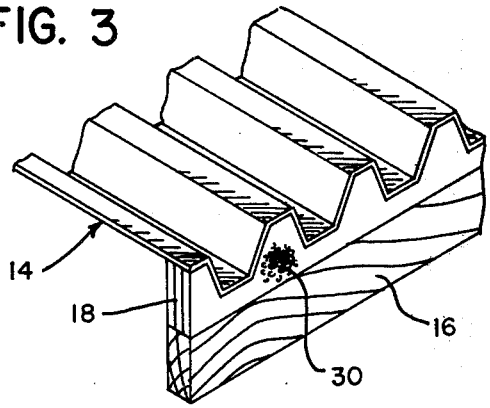
FIG. 4
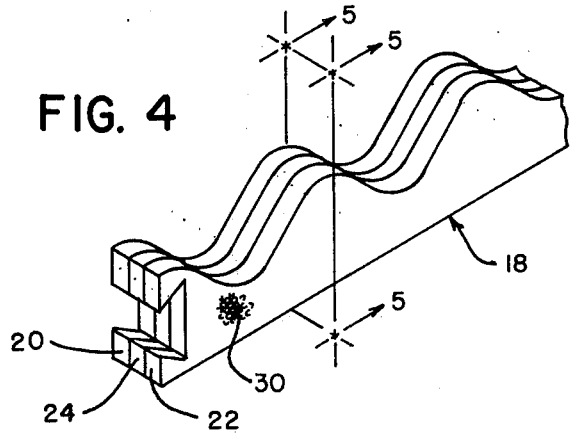
FIG. 5
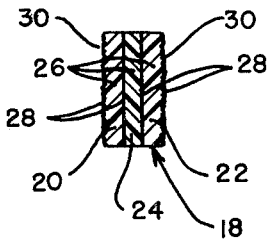
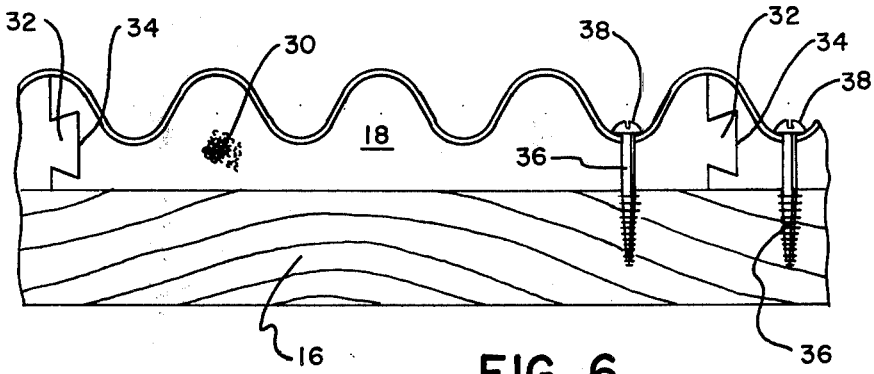
FIG. 6
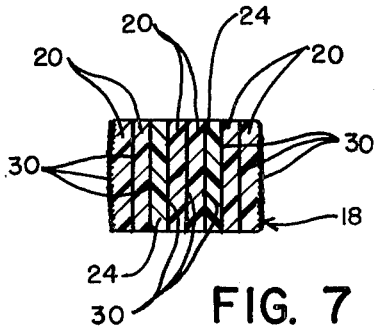
FIG. 7

CLOSURE STRIP

BACKGROUND OF THE INVENTION

1. Field of the Invention

The invention concerns sealing elements or strips to be employed in building constructions which utilize corrugated or other panels having sinuous configurations for sheathing building walls, roofs and the like. In the case where the panels are supported by framing members, the sealing strips are interposed between the framing member or members adjacent the lower ends of the panels and the under or inner sides of the panels to carry the load of the panels and to provide a relatively watertight and airtight joint with the framing member or members. The strips may also be employed in situations where the panel supporting structure is not involved but the panels are in contact with straight line surfaces and the voids between the panels and such surfaces must be sealed. The sheathing panels may have different surface configurations and consequently the shaping of the panel supporting surfaces of the sealing strips to conform to panels of various types is a necessity and is conventional.

2. Description of the Prior Art

Heretofore sealing strips of various constructions have been used or proposed in which the strips, or at least the portions thereof which are to contact the corrugated sheathing panels, are formed of suitable resilient materials. In one prior construction, each sealing strip is composed of a single relatively wide strip of a resilient plymer, such as polyvinyl chloride, ethylene propylene terpolymer, or neoprene, the upper surface of the strip being shaped to conform to the corrugated panel with which it is to be used. In another known construction disclosed in U.S. Pat. No. 2,853,330, a similar one-piece sealing strip is disclosed which is composed of an elastomeric material such as rubber. Such prior one-piece sealing strips do not have the desired load carrying capacity and become readily distorted.

U.S. Pat. No. 3,385,018, which refers to U.S. Pat. No. 2,853,330 mentioned above, describes and illustrates a sealing strip having a relatively rigid lower or base member formed of a material such as wood, inexpensive rubber, sponge rubber, polystyrene, and the like. The upper surface of the base member is provided with a sinuous surface corresponding to the surface of the sheathing panels with which it is to be used. What is termed a "filler strip," which is relatively thin and of uniform thickness as compared to the base member and which is composed of any desired material selected from elastomers such as extruded vinyl, neoprene and the like, or a relatively high quality rubber, is secured to overlie the upper surface of the base member as by stitching it to the base member with the stitching strand extending through the base member and filler strip at the peaks and valleys of the corrugations of the base member. Alternatively, rust-proof staples may be used for securing purposes. While the construction of the patent has certain advantages over a sealing strip formed entirely of a single body of resilient material, it does not have the panel sealing and supporting efficiencies as provided by a sealing strip or element incorporating the instant invention.

SUMMARY OF THE INVENTION

A principal object of the instant invention is provision of improved sealing or closure strips or elements for use with sinuous sheathing panels, such as corrugated wall and roofing panels, and which perform the function of sealing the spaces between the corrugations of such panels and a supporting member or members or other element or elements to prevent the entrance therebetween of air, rain, snow and the like.

Another object of the invention is the provision of sealing or closure strips attaining the aforesaid object which are of a laminated construction and have superior panel supporting and sealing qualities.

A Further object of the invention is the provision of sealing or closure strips or elements attaining the foregoing objects which include means for readily attaching adjacent strips in end to end relationship.

The foregoing, and other objects of the invention which will become apparent, are attained by a sealing or closure strip or element, hereinafter referred to as a "sealing element," which is made up of a plurality of individual laminations. Each of the laminations is composed of a resilient polymer, such as polyethylene, polyurethane, ethylene propylene terpolymer, polyvinyl chloride, neoprene, or of other resilient material having equivalent sealing and supporting properties. The individual laminations are prepared by conventional processes employed for the production of molded articles of various types. For purposes of the instant invention, the selected resilient polymer, in a foamed state, is pressure molded into a strip or sheet. As a result, the molded strip or sheet has a porous interior composed of a plurality of minute cells and a relatively dense skin forming the outer surfaces thereof. The several molded strips or sheets are secured together in face to face relationship suitable by a fusing process of known type.

In accordance with the most used and preferred embodiment of the instant invention, the sealing elements are composed of three or five laminations. Depending upon the resistance to interior compression required for any particular application, the densities may vary from say 2 pounds per cubic foot to 8 pounds per cubic foot suitably in increments of 2 pounds per cubic foot and in any combination desired. For example, in a three or five lamination construction and where polyethylene, a preferred material, is employed, the intermediate or central lamination may have an interior density of suitably approximately 4 pounds per cubic foot while the outer or other laminations have interior densities of suitably approximately 2 pounds per cubic foot. For the purposes of the instant invention, during the sheet or strip molding process referred to above, the faces of the outer laminations which are to be exposed are preferably provided with a waffled effect.

The individual sealing elements are cut from the laminated sheets or strips into the desired configuration to provide a straight line lower edge and an upper edge of the shape required to conform with the particular corrugated or other sinuous sheathing panel with which the sealing elements are used. Also, the sealing elements are shaped at their ends to provide means for interlocking adjacent elements, such as a dovetail at one end and a corresponding dovetail slot at the other end. Consequently, the strips may be readily assembled in aligned relationship to provide a continuous strip of the length required for any particular use.

DESCRIPTION OF THE DRAWINGS

FIG. 1 is a fragmentary perspective view illustrating a sealing element of the invention employed with a corrugated sheathing panel;

FIG. 2 is a view similar to FIG. 1 showing the sealing element of the invention employed with a second form of sheathing panel;

FIG. 3 is a view similar to FIGS. 1 and 2 disclosing the sealing element of the invention employed with a third form of sheathing panel;

FIG. 4 is a fragmentary perspective view on an enlarged scale of a sealing element of the type employed with the sheathing panel of FIG. 1;

FIG. 5 is a sectional view taken on the line 5—5 of FIG. 4 looking in the direction indicated by the arrows;

FIG. 6 is a side elevational view of endwise adjacent sealing elements employed with sheathing panels of the type shown in FIG. 1; and FIG. 7 is a view similar to FIG. 5 illustrating a modified form of the sealing element.

DESCRIPTION OF THE PREFERRED EMBODIMENT

Referring to the drawings and particularly to FIGS. 1–3, there is disclosed different types of sheathing panels representing a few of the many configurations of such panels which are or may be employed in the building industry. In FIG. 1 the panel 10 is of a true or conventional corrugated configuration. In FIG. 2 the panel 12 has rather deep angular corrugations alternating with relatively shallow corrugations, the latter having relatively wide lower portions and the corrugations being connected by relatively narrow and flat portions. In FIG. 3 the corrugations of the panel 14 are also of angular rather than rounded configuration. As mentioned above, the panels shown in FIGS. 1–3 are merely representative of the many types of panels with which the sealing strips of the present invention may be employed.

Panels 10, 12 and 14 may be constructed of any suitable material such as asbestos-cement, galvanized steel, or plastics, as conventionally used for sheathing panels, such as wall and roofing panels. The panels are supported in each instance adjacent their lower or outer ends by a longitudinally extending building frame member 16 which may be of steel or wood or other suitable material, but which is shown for purposes of convenience as a wooden member. The sealing element of the instant invention indicated by the reference character 18 and which is individually shown in a representative form in FIG. 4 is inserted between the frame member 16 and the overlying panels, such as panels 10, 12 or 14. As illustrated, the sealing element 18 extends transversely with respect to the corrugations of the panels and longitudinally of the frame member 16.

Referring now particularly to FIGS. 4 and 5, the preferred embodiment of the sealing element 18 will be described. As previously pointed out, in such embodiment the number of laminations may be either three of five but usually five. However for the purpose of convenience in illustration, the sealing element is shown in the drawings as made up of three laminations including outer laminations 20 and 22 and an inner lamination 24 sandwiched therebetween. The laminations are normally of approximately the same thickness, the several laminations suitably having a total thickness or width of approximately one inch. As previously mentioned, each lamination is composed of a resilient polymer, such as polyethylene, polyurethane and ethylene propylene terpolymer, polyvinyl chloride or neoprene or other material having equivalent load-bearing and sealing properties. Also as earlier pointed out, in the formation of the sheets or strips which are to constitute the laminations 20, 22 and 24, the sheets or strips are individually pressure molded of the selected material while the latter is in a foamed condition whereby each of the resultant laminations, as illustrated particularly in FIG. 5, has a porous interior 26 and relatively nonporous and dense surface skins 28. In the formation of the sheets or strips which are to constitute the outer laminations 20 and 22 of the sealing elements, the faces thereof to be exposed are molded to have a waffled effect, as illustrated in FIGS. 5 and 6 at 30. In the molding operations, uniform pressures may be employed to produce strips or sheets for the several laminations which have interiors of the same densities, or alternatively, the sheet or strip for the intermediate laminations 24, or the two intermediate laminations if five laminations are employed, is molded to have substantially twice the interior density of the sheets or strips for the outer laminations 20 and 22. For example, and as previously pointed out, where the preferred material, polyethylene, is employed, the interior density of laminations 24 may be approximately 4 pounds per cubic foot and the interior densities of laminations 20 and 22 may be approximately 2 pounds per cubic foot. The several sheets or strips making up the laminations are preferably secured together in the proper order to provide the laminated structure of FIG. 4 by a flame fusing process or they may be clamped together while they retain the heat of the molding operation to cause their adhesion or fusion to one another, both such methods being of known type.

The sealing elements 18 are cut from the laminated sheets or strips prepared as described above, the edges of the sealing elements which are to rest against the corrugated or other sinuous sheathing panels being given the required configuration to contact the inner or lower surfaces of the panels throughout the lengths of the sealing elements. The dimensions of the sealing elements may be selected as desired, but for most uses the sealing elements are preferably three feet in length, have a height to accommodate the corrugations or other surface configurations of the panels which they will underlie, leaving approximately ¼ inch of the material at the thinnest parts, and a width of about one inch.

The ends of each sealing element 18 are provided with means for readily interlocking the element with endwise adjacent sealing elements in order that a continuous length of the elements may be provided as required for the roofing or siding construction with which the sealing elements are employed. In the preferred embodiment, as illustrated in FIG. 6, such interlocking means consists of a dovetail 32 at one end of the strip and a cooperating dovetail slot 34 at the other end of the strip. Due to the materials employed and the laminar construction of the elements, such dovetails and slots may be readily cut.

The sheathing panels 10 are secured to the sealing elements 18 and the latter in turn are secured to the framing members 16 by any suitable means, the specific means depending primarily on the construction of the framing members 16 or other members between which and the panels the sealing elements are inserted. In the event that the members are of wood, the securing means preferably will constitute screws such as shown at 36 in FIG. 6, the screws being located in the valleys of selected corrugations and centrally of the sealing strips. The screws have heads 38 with marginal portions thereof resting on the sheathing panel 10 and the shank of the screw penetrates an opening or perforation in the sheathing panel, penetrates the sealing element 18, and is threaded into the framing or other member 16. Alternatively, nails may be employed. In the case where the framing or other element 16 is of a metallic or other material not subject to penetration by ordinary screws or nails, sheet metal screws, bolts or studs similarly located as screw 36 may be suitably employed as the securing means.

Referring now to FIG. 7, a somewhat modified construction of the sealing element is illustrated which is adapted particularly for use where the overlying load may be a heavy one due, for example, to the use of sheathing panels as roofing panels which in winter may have to carry an unusually heavy snow load. In the construction shown, starting at either lateral side of the figure, the sealing element comprises two of the relatively low density laminations, such as lamination 20, one of the laminations 24 of the higher density type, two of the relatively low density laminations, such as lamination 20, another single higher density lamination 24, and finally two additional of the low density laminations. It will be understood that FIG. 7 discloses only one representative embodiment of a sealing element employing a greater number of laminations than the three or five laminations employed in the more usual embodiments and that other combinations of the laminations may be used. However, in any such combination and where laminations of different interior densities are employed, it is preferred that each lamination of higher density be interposed between the laminations of lower density. The only modification of the building construction over that shown in FIGS. 1–3 which may be required where the sealing element of the type illustrated in FIG. 7 or variations thereof are employed is the provision of a wider framing element 16 to accommodate it.

The sealing elements of the instant invention, as described above, fulfill the objects of the invention as previously set forth. Thus, they provide an efficient seal between the sheathing panels 10 and framing members 16 which successfully prevents the entrance of air, rain or other moisture. At the same time, due to the relatively dense structure of the skin layers of the individual laminations, the elements, even where the interior of the laminations are of the same relatively low density, have adequate load supporting properties for many uses. Such load bearing properties may be enhanced by the employment of inner laminations of substantially increased interior density as compared to the interior densities of the outer laminations. The latter construction assures that the strips will adequately support the weight of the panels and a heavy load thereon, such as a snow load, without undue distortion of the sealing elements. The interlocking connections at the ends of the sealing elements, as provided by the dovetails 32 and the dovetail slots 34, permit the sealing elements to be readily assembled to provide the length required for the particular building wall or roof construction in which the elements are employed. The waffled surfaces of the laminations defining the outer lateral walls of the sealing elements prevent unsightly wrinkles when for any reason a sealing element is jammed in place or otherwise distorted as, for example, when the sealing element is installed after the installation of the overlying panel. The waffled surfaces also diffuse light reflection and provide a pleasing appearance.

I claim:

1. An elongated sealing element for interposition between a panel of corrugated configuration and a member extending transversely of said panel, said sealing element having an edge adapted to lie in contact with said panel, of a corrugated configuration corresponding to that of said panel, and said sealing element comprising a laminated structure with the laminations thereof extending longitudinally of the sealing element and with the opposite edges of said laminations adapted to underlie said panel and overlie said member respectively, said laminations having adjoining surface portions secured together and each of said laminations having a porous interior portion coextensive with said surface portions, the porous interior portion of at least one of said laminations having a density greater than the densities of the interior portions of other of said laminations.

2. A sealing element as defined in claim 1 wherein said laminations are comprised of a resilient polymer.

3. A sealing element as defined in claim 2 wherein said surface portions of said laminations are relatively dense as compared to said porous interior portions thereof.

4. A sealing element as defined in claim 1 wherein said at least one of said laminations is interposed between two of said other laminations.

5. A sealing element as defined in claim 1 wherein said laminations include laminations defining the outer lateral faces of said sealing element and said laminations defining said outer lateral faces have waffled exposed surface portions.

6. A sealing element as defined in claim 1 wherein a plurality of said sealing elements are adapted to be placed end to end to provide an elongated sealing means and the ends of said elements include means extending transversely thereof for providing interlocking connections with the ends of endwise adjacent elements.

7. A sealing element as defined in claim 6 wherein said means for providing interlocking connections with the ends of endwise adjacent elements comprises a dovetail at one end of said element and a dovetail slot at the other end thereof.

8. A sealing element as defined in claim 3 wherein said other of said laminations include laminations forming the outer lateral faces of said sealing elements and said laminations forming said outer lateral faces have waffled exposed surface portions.

9. A sealing element as defined in claim 8 wherein a plurality of said sealing elements are adapted to be placed end to end to provide an elongated sealing means and the ends of said elements are provided with means extending transversely thereof for providing interlocking connections with the ends of endwise adjacent elements.

10. A sealing element as defined in claim 9 wherein said means for providing interlocking connections with the ends of endwise adjacent elements comprises a dovetail at one end of said element and a dovetail slot at the other end thereof.

11. A sealing element as defined in claim 2 wherein the resilient polymer of which said laminations are comprised is polyethylene.

12. A sealing element as defined in claim 4 wherein the interior portion of said at least one of said laminations interposed between two of said other laminations has a density of approximately 4 pounds per cubic foot and the interior portions of said two of said other laminations have densities of approximately 2 pounds per cubic foot.

* * * * *